US009518407B2

(12) United States Patent
Thoonsen

(10) Patent No.: US 9,518,407 B2
(45) Date of Patent: Dec. 13, 2016

(54) ANTITHEFT DEVICE FOR LIQUID CONTAINER

(75) Inventor: Jacky Thoonsen, Chateauroux (FR)

(73) Assignee: Thoonsen Trading, Chateauroux (FR)

( * ) Notice: Subject to any disclaimer, the term of this patent is extended or adjusted under 35 U.S.C. 154(b) by 0 days.

(21) Appl. No.: 14/233,922

(22) PCT Filed: Jul. 20, 2012

(86) PCT No.: PCT/FR2012/051727

§ 371 (c)(1),
(2), (4) Date: Mar. 5, 2014

(87) PCT Pub. No.: WO2013/011248

PCT Pub. Date: Jan. 24, 2013

(65) Prior Publication Data

US 2014/0191871 A1 Jul. 10, 2014

(30) Foreign Application Priority Data

Jul. 21, 2011 (FR) ..... 11 56640
Nov. 18, 2011 (FR) ..... 11 60532

(51) Int. Cl.

| | |
|---|---|
| ***E05B 73/00*** | (2006.01) |
| ***G09F 3/03*** | (2006.01) |
| ***G09F 3/14*** | (2006.01) |
| *B65D 63/10* | (2006.01) |
| *B65D 63/08* | (2006.01) |

(52) U.S. Cl.

CPC ..... *E05B 73/0041* (2013.01); *E05B 73/0017* (2013.01); *G09F 3/037* (2013.01); *G09F 3/14* (2013.01); *B65D 63/08* (2013.01); *B65D 63/1027* (2013.01)

(58) Field of Classification Search

CPC ..... E05B 73/0041; E05B 73/0017; B65D 63/1027; B65D 55/08

See application file for complete search history.

(56) References Cited

U.S. PATENT DOCUMENTS

| | | | | |
|---|---|---|---|---|
| 2005/0062608 | A1* | 3/2005 | Costa | 340/572.9 |
| 2006/0170559 | A1* | 8/2006 | Marsilio et al. | 340/572.9 |
| 2007/0120701 | A1* | 5/2007 | Teller | E05B 73/0017 340/693.9 |
| 2008/0073383 | A1* | 3/2008 | McDonald | 222/500 |
| 2010/0005840 | A1* | 1/2010 | Hogan | 70/63 |

* cited by examiner

*Primary Examiner* — Hongmin Fan

(74) *Attorney, Agent, or Firm* — Gordon Rees Scully Mansukhani LLP; David R. Heckadon

(57) ABSTRACT

An anti-theft device (1) comprising a ring (2), means (4) to lock (4) the ring in the closed position, and anti-theft detection means (3), wherein the ring comprises a body (20) that has a first end (21) near which the locking means are associated, a second opposite free end (22) designed to be introduced in the locking means, and at least one circular part (23) extending from the second end (22) and designed to cooperate with said locking means, characterized in that the body of the ring comprises a linear part (24) that is arranged to extend from the circular part (23) opposite the second end (22). The linear part provides complementary elasticity to the device which contributes to the ejection of the second end of the ring outside the locking means.

19 Claims, 2 Drawing Sheets

ANTITHEFT DEVICE FOR LIQUID CONTAINER

CROSS-REFERENCE TO RELATED APPLICATIONS

This application is a United States national stage entry of International Application serial no. PCT/FR2012/041727 filed Jul. 20, 2012, which claims priority to French Patent Application Serial No. FR1156640 filed Jul. 21, 2011 and French Patent Application Serial No. FR1160532 filed Nov. 18, 2011. The contents of both of these prior applications are incorporated herein by reference in their entirety as if set forth verbatim.

FIELD

The innovation relates to the field of anti-theft devices for items sold in stores, comprising remote alarm triggering systems, particularly anti-theft devices for bottles or similar containers.

The innovation shall be particularly described by reference to anti-theft devices for bottles without being limited to them, and applies to anti-theft devices for all liquid containers such as bottles, cans, drums etc.

BACKGROUND

For Some bottles of wine, appetizer drinks and spirits are of course far more valuable than others. Thus, such bottles are fitted in stores such as supermarkets with anti-theft devices adapted to be tightened and locked around the neck of the bottles.

Such an anti-theft device is known from the international patent application WO 2008/075310. The device in that document comprises firstly a body defining an internal cavity in which a magnetic locking system is housed and secondly a so-called latch attached pivotally to one of the parts of the body of the device, the free end of which is designed to be introduced in the cavity and work with the locking system in order to lock the anti-theft device around the neck of a bottle. The body and the locking piece both have a semi-circular profile to make up an annular shape in the locked position of the device so as to circle the cylindrical neck of the bottle. To unlock the device, a detacher known in itself is set against the body of the device to unlock the system magnetically. In order to push the latch out of the body of the device during unlocking, elastic means of the spring type or elements in elastic material are provided and associated with the cavity of said body.

However, in spite of the presence of the elastic means, the device is not optimal for achieving the reliable and quick removal of the latch out of the body of the device.

This innovation is thus aimed at providing an anti-theft device for items to be protected of the liquid container type, wherein the device is adapted to be easily and rapidly put in place on the item, and wherein the removal of the latch or locking ring is particularly quick, while offering the benefit of not requiring outside help such as manual pulling.

SUMMARY

The anti-theft device comprises a ring or collar, means to lock the ring in the closed position, and anti-theft detection means, wherein the ring comprises a body that has a first end near which the locking means are associated, a second opposite free end designed to be introduced in the locking means and at least one circular part extending from the second end and designed to cooperate with said locking means and is characterized in that the body of the ring comprises a linear part that is arranged to extend from the circular part opposite the second free end.

Thus, the linear part provides complementary elasticity to the device, which allows the effective and instantaneous removal of the second end out of the locking means.

In particular, the linear part is straight over at least 15% of the length of the ring body, preferably over 15% to 25% of the length.

According to one characteristic, the body of the ring is made of plastic material, such as PVC, and preferably made of plastic material only and does not contain any metal component.

In order to provide adequate elasticity, the linear part must be sufficiently flexible. Its thickness must therefore be adapted accordingly. For example, it is between 1.2 mm and 2 mm thick, preferably between 1.4 and 1.6 mm thick.

The thickness of the circular part must on the other hand be less flexible and its thickness must be approximately 1.5 times to twice the thickness of the linear part.

According to another characteristic, the body of the ring comprises a curved part that extends from the linear part opposite the circular part and ends with the first end. That curved part bearing the locking means advantageously has the same thickness as the linear part and is itself just as flexible, which leads to a circular profile of the linear and curved parts when the ring is tightened, which finally gives the device closed around the cylindrical part (neck of the bottle) an annular shape.

Preferably, the circular part of the ring designed to cooperate with the locking means is thicker than the linear part. Even though it remains flexible, it is more rigid than the linear part.

According to another preferred characteristic, the curved part and the linear part of the ring (parts that are not inserted in the locking means) have a longitudinal rib on the inner wall of the ring; the rib is preferably centred on the height of the ring and extends from the end of the circular part up to the locking means.

The rib is approximately 2 mm thick.

The rib is designed to cooperate with the underside of the ring of the bottle, as it is set and tightened against it. The rib makes the anti-theft device more secure, by preventing the risk of a blade or a similar tool being inserted between the ring and the neck of the bottle.

Advantageously, the circular part of the ring on the outer wall of the body is crenelated in part from the free end, which makes it possible, due to the presence of grooves, to lock the ring when the grooves cooperate with the teeth of a notched part associated with the locking means.

Thus, the locking means comprise, accommodated in a rigid enclosure, a notched part designed to cooperate with a crenelated portion of the circular part of the ring and adapted to move so as to be dissociated from said crenelated portion.

Further, the locking means comprise a retaining piece in magnetic material that is adapted to move and is associated with a spring, wherein the retaining piece is associated with the notched piece.

According to another characteristic, the detection means are housed in a housing that is integral with the outer wall of the body of the ring and arranged at the circular part and diametrically opposed to the second end.

The detection means comprise an electronic theft detection system of the radiofrequency or acousto-magnetic type, which can trigger a remote alarm.

The body of the ring, the detection means housing and the rigid enclosure of the locking means are preferably made by moulding, in particular with the same plastic material.

Further, on its outer wall, the ring comprises a pin, particularly extending transversely to the circular part at a proximal portion. The pin makes it easier to grasp the device and helps implement it. Preferably, the pin has a convexity against which the palm of the index finger of the user is intended to be applied.

Besides, in a particular embodiment, especially for bottles with screw caps, the device comprises hood application means designed to cover the screw cap with a cap, which very advantageously prevents the unscrewing of the cap. The hood application means, such as a cap, form a projecting part that extends transversely to the plane containing the body of the ring and is placed opposite the inner tightening volume of the ring.

When the screw cap is capped in a combined manner with the tightening collar that firmly circles the neck of the bottle, the screw cap cannot be loosened. The system is particularly useful in retailing stores in order to stop customers from opening bottles on the spot and consuming their contents.

Lastly, the anti-theft device also constitutes a device to check/display in a tamper-resistant manner the price or the price range of an item, so as to allow the identification of the price or price range of an item such as a bottle or other item containing a liquid, wherein the device (the ring or collar or the hood application means) comprises means for price identification/determination.

Thus, the collar associated with the locking means forms price identification means that cannot be substituted. Indeed, the collar firstly bears or forms the price identification means and secondly constitutes hooking means that allow the locked fastening of the device around the item without it being possible to remove or replace said device.

Preferably, the device comprises a family of rings and/or hood application means in different colours, wherein each colour corresponds to a different price range; in particular, each ring and/or each closure means constitutes part of the price display means.

According to one characteristic, the ring, particularly the housing accommodating the detection means, or the hood application means comprise a support plate on which an adhesive price label is glued or on which a price is engraved.

The housing of the detection means or the hood application means may form he identification/determination means.

Preferably, the housing has the shape of a flat parallelepiped and is associated with the body of the ring, wherein the housing has at least three affixing surfaces, a top, an underside and a front that may be used to add a price (label or engraving).

Advantageously, the parallelepiped shaped housing has a dimension (height) transverse to the longitudinal body of the ring that is equal to or slightly greater than the height of said ring body, but not more than twice that height.

In the description below, the term "height" and the words "top" and "underside" are used by reference to normal installation, that is to say relative to the installation of the device (ring) on a bottle that is vertically positioned.

The anti-theft device is more particularly used without limitation around a cylindrical body, preferably a cylindrical body of a liquid container such as the neck of a bottle, particularly an appetizer wine or a spirit, the upper ring of a can or the neck of a drum, particularly automotive oil.

This device will now be described with only illustrative and non-limiting examples by reference to the annexed drawings.

DETAILED DESCRIPTION

Figure 1:
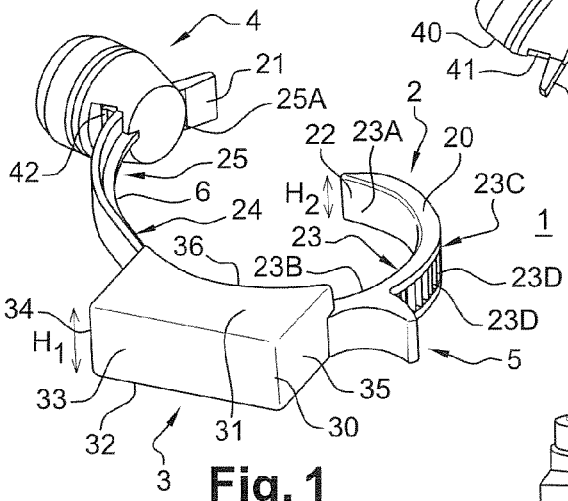
FIG. 1 is a perspective view of the device in the open position.
Figure 2:
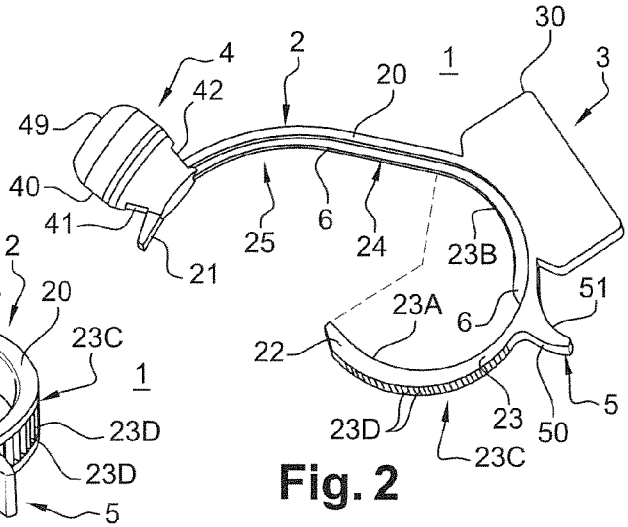
FIG. 2 is a top view of the device in the open position.
Figure 3:
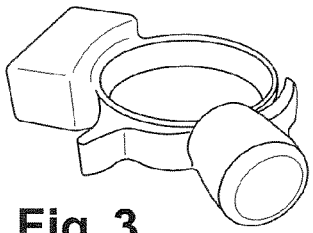
FIG. 3 is a perspective view of the device in the closed position.
Figure 4:
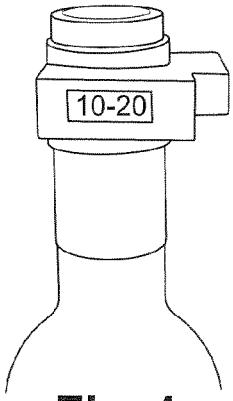
FIG. 4 is a front view of the device in its position of use around the neck of a bottle.
Figure 5:
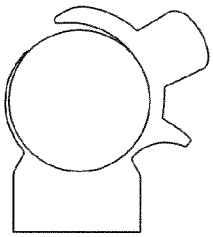
FIG. 5 is a top view of FIG. 4.

The anti-theft device 1 represented in FIGS. 1 to 3 is designed to cooperate, by reference to FIGS. 4 and 5, with the neck of a bottle. This example of use is not limited and the device may be placed on any cylindrical shape of a container such as the neck of a drum or a can.

By reference to FIGS. 1 and 2 illustrating the anti-theft device 1 in its open position (unlocked), the device is made up of a collar comprising a fastening ring 2, anti-theft detection means 3 and locking means 4. The fastening ring 2 makes it possible to make the collar integral with the neck of the bottle by the fact that it cooperates with the locking means 4. After fastening (FIG. 5), the collar encloses the neck by contact and it is impossible to insert any object or cutting tool between the ring and the neck.

The ring 2, as illustrated in FIGS. 1 and 2 in its open position, when the device or collar is thus unlocked, has a longitudinal body 20 with two opposite ends 21 and 22. The first end 21 bears the locking means 4, whereas the second end 22 is free and designed to cooperate with said locking means.

The body 20 is made of rigid plastic material, for example polyvinyl chloride (PVC). Preferably, it is made only of plastic material and does not contain any metal component. The body is sufficiently flexible to allow manipulation so as to insert the free end 22 in the locking means 4 and apply pressure to continue the insertion in order to reduce the diameter of the ring till it is adequately tight.

The body 20 comprises several parts with distinct geometric lines. Unlike the prior art, it does not have a totally circular shape in the open position. Thus, the body 20 of the ring successively comprises a so-called circular part 23, a linear (straight) middle part 24 and a so-called curved part 25.

The detection means 3 are fixed to a portion of the circular part 23, substantially at its joint with the straight part 24. The means 3 are fastened on the side opposite the concavity defined by said three parts 23, 24 and 25.

The circular part 23 extends from the free end 22 to the linear part 24. Its curvature is much more pronounced than that of the curved part 25. Thus, its line substantially forms an arc along an angle at the center of at least approximately 210 and 260°, for example 250°, as visible in FIG. 2 in dotted lines. The arc comprises a distal portion 23A near the end 22 and a proximal portion 23B extending the distal portion 23B and juxtaposed with the linear part 24.

By reference to FIG. 1, on the outer wall of the ring, opposite the inner part that is designed to be in contact with the neck of the bottle, the circular part 23 is crenelated in part over a portion 23C forming a series of indentations 23D.

That succession of indentations extends from the free end 22 to the proximal part 23B and upstream from the detection means 3.

Each indentation 23D is developed on the height of the collar in a plane where the inclination in relation to the tangent of the arc is directed to the detection means 3.

As described below, the indentations 23D form grooves that are designed to cooperate with the teeth of the locking means 4 when the device is in the closed position.

The curved part 25 connected to the end 21 bearing the locking means 4 makes it necessary for the collar to end in a substantially rounded shape to obtain a circular shape in the closed position of the collar as it cooperates with the end 22 and the circular part 23.

According to the device, the presence of the linear part 24 gives the ring 20 an elastic effect during unlocking. While unlocking, that linear part makes it possible to effectively contribute to the ejection of the end 22 outside the locking means 4. Its linear shape goes against the circular arrangement imposed on the ring in the closing position. Thus, when the end 22 is detached from the locking system internal to the means 4, that linear part 24, which is given a curved shape when it is in use, immediately tends to go back to its straight resting shape.

As it comes back to its resting state, the linear part 24 makes the end 21 move away towards the outside of the collar, which contributes to the clearing of the free end 22 outside the locking means 4.

The linear part 24 extends from the distal portion 23B. Its line is straight. It extends over a length that depends on the size of the ring, which in turn depends on the diameter that is to be enclosed.

Preferably, the linear profile extends over 15% of the length of the body 20 of the ring.

The liner part is flexible so as to be deformed to follow a curved profile. To that end, it is preferably 1.4 to 1.6 mm thick.

Preferably, the curved part 25 and the linear part 24 of the ring (parts that are not inserted in the locking means) have a longitudinal rib 6 on the inner wall of the ring; the rib is preferably centred on the height of the ring and extends from the end of the circular part up to the locking means.

The rib 6 is approximately 2 mm thick. It is designed to be applied under the ring of the bottle when the device is in the mounted position on the bottle.

Figure 6:
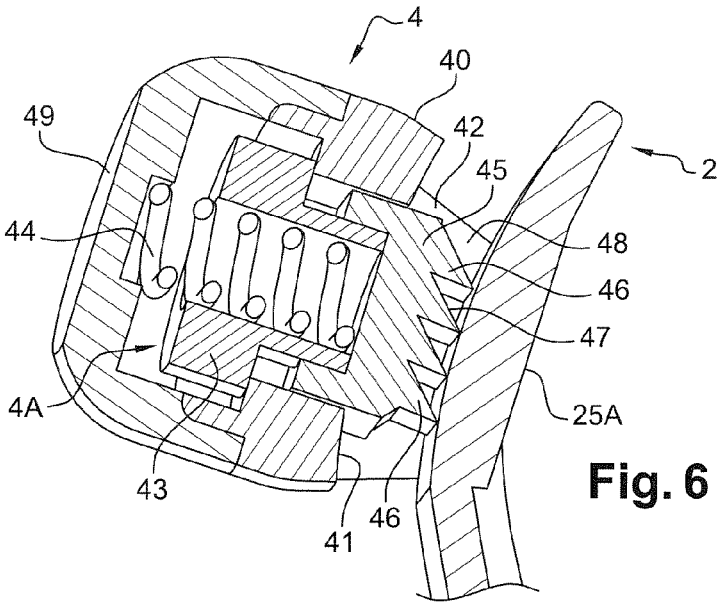
FIG. 6 is a detailed sectional top view of the device.

The ring 2 is designed to be closed after it is put in place around the neck of the bottle, wherein its two ends are joined and fixed to each other in a tamper-resistant manner using the locking means The locking means 4 as illustrated in FIG. 6 comprise a locking system 4A known in itself that has been described succinctly below.

The locking system 4A is housed in a rigid enclosure 40, preferably in the same plastic material as that of ring 2. The enclosure protrudes in relation to the body of the ring.

The enclosure or the housing 40 has an entry opening 41 adjacent to the outer wall of the ring and placed near the linear part 24 of the ring, and an opposite exit opening 42 also contiguous with the outer wall.

Between the two holes 41 and 42 is arranged an inner channel 48 that follows the curved shape of the opposite curved portion 25A of the ring 2. The channel is designed to accommodate the crenelated portion 23C of the ring, in the closed position of the collar.

The locking system 4A comprises a retaining piece 43 in magnetic material that is adapted to be moved and is associated with a spring 44. The piece is mobile transversely to the curved portion 25A of the ring 2 bearing the rigid enclosure.

The locking system is further fitted with a notched locking piece 45. That piece is advantageously in plastic material such as PVC.

The notched piece 45 is integral in displacement with the mobile piece 42.

Opposite the portion that makes it integral with the mobile piece and facing the body of the ring 2, the notched piece 45 comprises a plurality of teeth 46.

The teeth 46 are separated by cut corners 47, the angle of which is directed to the entry opening 41.

In the locking position, the portion 23C of the ring is engaged in the channel 48 of the locking means, wherein the grooves of the portion 23C cooperate with the teeth 46 of the locking system, wherein locking is provided by the angle in the opposite direction of the indentations 23D and the cut corners 47.

The magnetic material of the retaining piece 43 makes it possible to unlock the ring by dissociating the crenelated portion 23C from the notched piece 45. Indeed, by applying against the enclosure 40, more particularly against the side 49 opposite the body of the ring 2, a usual anti-theft device detaching tool (not shown), generally named a detacher and made up of a powerful magnet, the mobile retaining part 43 is drawn to the detacher in the direction opposite the ring. By moving, it frees the coupling of the portion 23C with the notched part 45 and under the effect of the spring 44 associated with the mobile piece, the circular part 23 of the ring is ejected outside the enclosure 40, thus opening the ring 2 and leading to the position shown in FIG. 2.

However, to maximize such ejection, the device as stated above has elastic means on the ring 2 itself being made up of the linear profile 24 of the proximal part of the ring. Said profile 24, which is deformed into a curve when the device is fixed to a bottle neck, reverts to its original straight shape once the part 23A is released from the locking means 4A.

The anti-theft device may also have detection means 3. The detection means 3 comprises a detection system that is not described in greater detail here, as its working is known; it is housed in a rigid housing 30 associated with the circular part 23 of the ring 2.

The detection system is adapted to remotely trigger an alarm of the radiofrequency or acousto-magnetic type.

The housing 30 is preferably made of the same plastic material as the ring and is obtained by joint moulding with the ring.

The housing 30 is placed against the outer wall of the ring 2, diametrically opposite the free end 22 and at the proximal portion 23B of said circular part 23. It protrudes in relation to the body of the ring 2.

Advantageously, the housing 30 further forms means to identify/display/determine the price or price range of the item with which the anti-theft device is intended to be used.

The housing 30 makes up a support to display or print a price or a price range and/or its colour provides a means to determine a price range. Preferably, the whole device 1 is of the same colour as the housing 30.

According to FIGS. 1 and 2, the housing 30 is shaped substantially like a parallelepiped and comprises several sides that make up surfaces providing the possibility to affix price information.

Thus, by reference to FIG. 1, the housing comprises a top 31, an underside 32 opposite it, a so-called front 33 and two opposite sides 34 and 35 that connect the front 33 to the ring 2 with which said housing is associated. The so-called rear 36 of the housing, which is associated with the ring 2 corresponds to the circular portion 23B of the ring and has its curved profile.

The size of the housing 30 is compact but sufficient to provide display surfaces that are appropriate for reading the information stated on it (FIG. 4).

Preferably, the housing has a height H1 that is no larger than twice the height H2 of the ring. It must be remembered that the height is the dimension transverse to the longitudinal body of the ring and corresponding to the vertical dimension when the bottle is upright.

Further, the dimensions of the detection system are adapted to the size of the housing 30.

For example:

the height H2 of the body of the ring is 6 mm the height H1 of the housing 30 is 12 mm the length of the housing (parallel distance in a plane tangential to the ring) is 40 mm.

The size of the ring 2 of the anti-theft device is adapted for the diameters of the containers to hold, and the dimensions of the housing 30 can be as small as those stated above.

For cans, the diameter of the closed ring would for example range from 50 to 60 mm.

As an example, to cooperate with a bottle where the neck dimensions vary depending on the bottle, here with a neck diameter varying between 25 and 60 mm, the device dimensions are as follows:

the length of the ring in the open position between the two ends 21 and 22 is 140 mm;

in the closed position, the diameter of the ring is no more than 35 mm;

the curvature radius of the circular part 23 of the ring is 19.3 mm;

the length of the linear part 24 of the ring is 18.5 mm;

the curvature radius of the curved part 25 of the ring is 35.7 mm;

the thickness of the linear and curved parts is 1.5 mm, the thickness of the circular part, which must be less flexible than the linear and curved parts, is 3 mm.

Regarding the housing 30 as a means to display/identify prices, the affixing surfaces, essentially the front 33 and the top 31 and underside 32, are designed to carry information, such as a price or price range, which may be engraved directly in plastic or printed on adhesive labels, preferably very highly adhesive labels.

However, the affixing surfaces are not always designed for bearing information. The device made up of at least the ring 2 and the housing 30 has a single color. Several families of devices are designed and each family is differentiated by a distinct color. Each color represents a price range For example, black may correspond to a price less than € 10, green a price range from € 10 to 20, yellow a price range from € 20 and 50, blue a price range from € 50 and 100 and red may correspond to a price above € 50.

Besides, the anti-theft collar (FIGS. 1 and 2) has, on its outer part, a pin 5 integral with the body 20 of the ring and arranged close to the detection means 3 between said means and the free end 22 of the ring. The pin 5 extends substantially orthogonally to the body of the ring. It has a form that is substantially curved, with a convexity 50 that is opposite the housing 3 or a concavity 51 opposite said housing.

Figure 7:
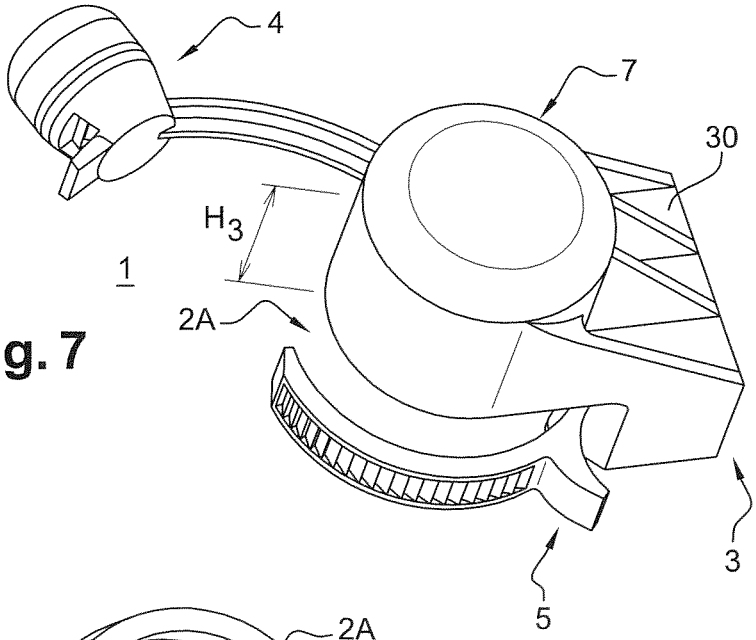
FIG. 7 is a top perspective view of an alternative embodiment of the device.
Figure 8:
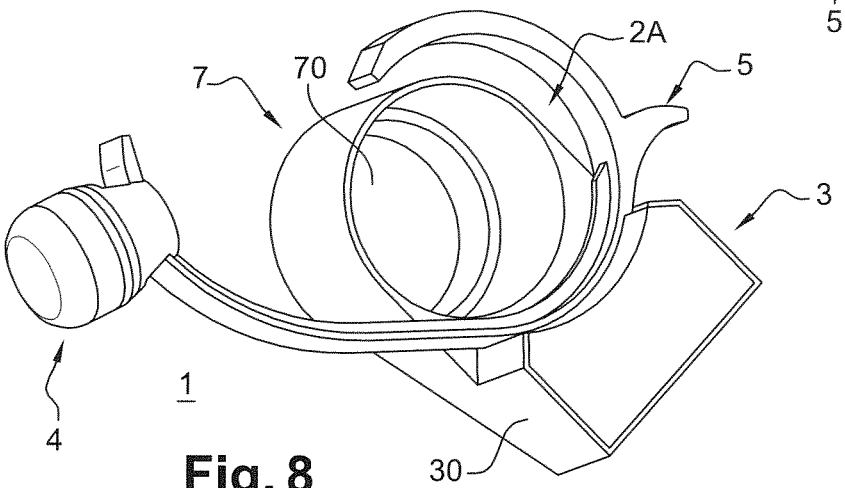
FIG. 8 is a bottom view of FIG. 7.

Lastly, in a particular embodiment, by reference to FIGS. 7 and 8, particularly for an anti-theft device used for a bottle with a screw cap, the anti-theft device complementarily comprises encapsulating or capping/hooding means 7 as represented here by a cap and designed to cover the screw cap of the bottle.

The dimensions of these capping means 7 are appropriate in height and width to cover the totality of the screw cap in order to prevent unscrewing.

The capping means 7 make up a part 71 that protrudes out of the device, extending transversely from the plane containing the body of the ring and placed facing the inner tightening volume 2A of the collar.

That protruding part has a height H3 adapted to the height of the bottle cap. It forms a rigid cylindrical enclosure shut at one of its ends and provided with a blind cavity 70 designed to house the cap.

The capping means 7 are integral with the housing 3.

They may be made up of the same plastic material as the housing. As a preferred example, the material is different, the ring 2 and housing 3 are made of nylon, while the cap 7 is made of polycarbonate.

The housing 3 and the cap 7 may be made by moulding in order to be made integral.

Figure 9:
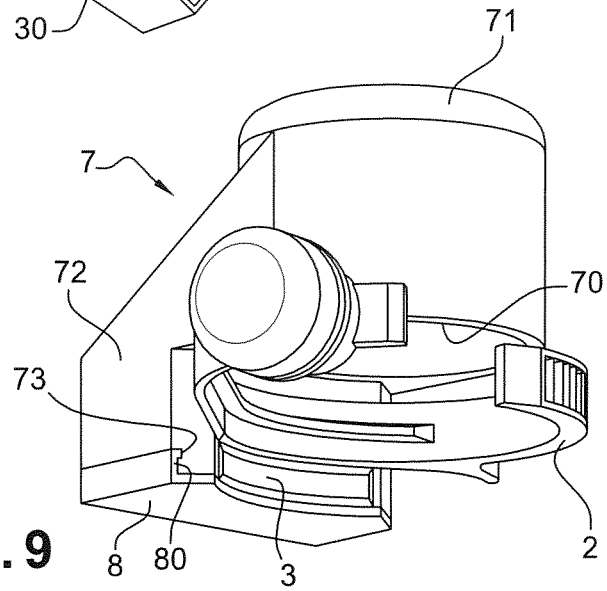
FIG. 9 is an alternative embodiment FIG. 7.

In a preferred embodiment, by reference to FIG. 9, the housing 3 and the cap 7 are fixed together by added means 8. The closure 7 includes the hood 71 and its cavity 70 and a foot 72 that is offset laterally in relation to the hood and arranged below said hood. The foot 72 is hollow to accommodate the housing 3, for example by fitting. To make the housing 3 integral with the foot 72, an added piece 8 is fastened in a non-removable manner at the base of the foot 72 to prevent the removal of the housing.

The non-removable fastening of the added piece 8 is for example obtained firstly by mechanical attachment, such as by clipping or by fitting male and female components (here a rib 80 of the piece sliding in an external groove 73 of the foot 72) and secondly by welding.

The working of the device will now be described, firstly for attaching the collar around the bottle, and secondly for detaching it.

The collar 1 is prepared by inserting the free end 22 in the entry opening 41 at the limit of the opening so that the collar, although closed, is not yet tightened and can be fitted around the neck.

Locking can then be carried out with a single hand, without necessarily having to hold the bottle with the other hand. The distal end of the palm of the index finger is set in the concavity 51 of the pin 5, whereas the palm of the distal end of the thumb is pressed against the surface 49 of the locking means 4. The collar is thus gasped.

Keeping the index finger set, at the same time pressing the thumb, makes the circular part 23 already introduced in the locking means turn, and the part continues its insertion in the channel 48 of the locking means. As long as the thumb pressure is maintained, the circular part 23 slides till the ring is fully tightened around the neck, and the free end possibly comes out of the exit opening 42 depending on the neck diameter. As the insertion progresses, the grooves of the crenelated part 23C work with the teeth of the notched part 45 and eliminate the possibility of loosening (possibility for the crenelated part to move out in the opposite direction).

After full tightening, when the thumb pressure is released, the ring is locked thanks to the working of the crenelated part 23C with the locking notched part 45.

To separate the anti-theft device, a detacher is put against the surface 49 of the locking means 4, which moves the notched part 45 away from the part 23C of the ring. The latter, once free, is ejected thanks to the presence of the spring 44 and expelled out of the housing 40 of the locking means without outside aid and very fast because of the linear profile configuration of the middle part 24 of the ring.

As a result, the use of the anti-theft device is simple and fast, particularly for unlocking. Further, the device as an anti-theft device and due to its configuration advantageously provides a device to check the price for the bottles. That device around a bottle cannot be substituted is easy to implement, and its use is fast as regards the understanding of the price by users (customers or check-out staff).

What is claimed is:

1. An anti-theft device (1) comprising:

a ring (2), a locking means (4) to lock (4) the ring in a closed position, and an anti-theft detection means (3), wherein the ring comprises:

a body (20) comprising a first end (21) near which the locking means are associated, a second opposite free end (22) designed to be introduced in the locking means to lock the ring, and said body having a circular part (23) extending from the second opposite free end (22) and designed to cooperate with said locking means (4) to lock the ring, and a straight part (24) configured to extend from the at least one circular part (23) opposite the second opposite free end (22), and a curved part (25) extending from straight part (24) such that the straight part (24) is positioned between the circular part (23) and the curved part (25), wherein the straight part (24) is deformable into a curve when the device is fixed to a bottle neck, and revertible to straight shape once the circular part (23) is released from the locking means (4); and wherein the circular part (23) is less flexible than the straight part (24).

2. A device according to claim 1, wherein the straight part (24) is straight over at least 15% of a length of the body of the ring.

3. A device according to claim 1, wherein the body of the ring is made of plastic material.

4. A device according to claim 1, wherein the thickness of the linear part (24) ranges between 1.2 mm and 2 mm.

5. A device according to claim 1, wherein the curved part (25) and the straight part (24) of the body of the ring comprise:

a longitudinal rib (6) on the inner wall of the ring, wherein the rib is centered on a height of the ring and extends from an end of the circular part up to the means to lock the ring.

6. A device according to claim 1, further comprising detection means (3) housed in a housing (30) integral with an outer wall of the body of the ring and arranged at the circular part (23) and diametrically opposed to the second opposite end (22).

7. A device according to claim 6, wherein the means to lock the ring (4) accommodated in a rigid enclosure (40) comprise, a notched part (45) designed to cooperate with a crenelated portion (23C) of the circular part (23) on the outer wall of the ring, and adapted to move so as to be dissociated from said crenelated portion.

8. A device according to claim 6, wherein the ring comprises a pin (5) disposed on the outer wall that extends transversely to the circular part (23).

9. A device according claim 1, further comprising a hood application means (7) that comprises a projecting part that extends transversely to a plane containing the body of the ring (2), wherein the projecting part is placed opposite an inner tightening volume (2A) of the ring.

10. A device according to claim 9, further comprising a check-display device configured to check and display in a tamper-resistant manner a price or a price range of an item so the price or price range of the item is identified by the check-display device, wherein the check-display device comprises a means to identify and determine the price or the price range.

11. A device according to claim 10, further comprising a family of rings and/or hood application means in different colors, wherein each color corresponds to a different price range, wherein each ring and/or each hood application means constitutes part of the check-display device.

12. A device according to claim 6, wherein the ring, particularly the housing (30) accommodating the detection means, comprise at least one support surface (62) on which an adhesive price label is glued or on which a price information is engraved.

13. A device according to claim 1, wherein the device is used around a cylindrical body.

14. A device according to claim 2, wherein the body of the ring is made of plastic material.

15. A device according to claim 14, wherein the body of the ring is made of plastic material only and does not contain any metal.

16. A device according to claim 3, wherein the body of the ring is made of plastic material only and does not contain any metal.

17. A device according to claim 1, wherein the thickness of the linear part (24) ranges between 1.4 and 1.6 mm.

18. A device according to claim 8, wherein the pin further comprises a convexity (50).

19. A device according to claim 11, wherein the ring, particularly the hood application means (7) comprise at least one support surface (62) on which an adhesive price label is glued or on which a price information is engraved.

* * * * *